US010525496B2

(12) United States Patent
Casas Cazalla et al.

(10) Patent No.: US 10,525,496 B2
(45) Date of Patent: Jan. 7, 2020

(54) AUXILIARY LOCAL FLUID DEPOSITION ELEMENT

(71) Applicant: AIRBUS OPERATIONS SL, Madrid (ES)

(72) Inventors: Israel Casas Cazalla, Getafe (ES); David Esteban Muñoz, Getafe (ES)

(73) Assignee: Airbus Operations SL, Madrid (ES)

( * ) Notice: Subject to any disclaimer, the term of this patent is extended or adjusted under 35 U.S.C. 154(b) by 215 days.

(21) Appl. No.: 15/619,059

(22) Filed: Jun. 9, 2017

(65) Prior Publication Data

US 2017/0354986 A1 Dec. 14, 2017

(30) Foreign Application Priority Data

Jun. 10, 2016 (EP) ..... 16173896

(51) Int. Cl.
*B05B 14/30* (2018.01)
*B05B 15/40* (2018.01)
*B05B 14/10* (2018.01)

(52) U.S. Cl.
CPC ..... *B05B 14/30* (2018.02); *B05B 14/10* (2018.02); *B05B 15/40* (2018.02)

(58) Field of Classification Search
CPC ..... B05B 14/30; B05B 14/10; B05B 15/40; B05B 1/28; B05B 12/36; B05B 14/00; B64F 5/10; B24C 3/065; B24C 9/003; B24C 1/10; B08B 2203/0229; B65D 83/30
USPC ..... 239/103, 104, 106, 110, 120, 124, 239/288–288.5; 118/326; 134/21
See application file for complete search history.

(56) References Cited

U.S. PATENT DOCUMENTS 5,489,234 A * 2/1996 Hockett ..... B23Q 11/0866 451/87
7,837,130 B1 * 11/2010 Lowery ..... B01D 46/10 239/120
8,801,499 B2 * 8/2014 Yoshizawa ..... B24C 9/003 451/38
2006/0011747 A1 1/2006 Jahnke et al.

FOREIGN PATENT DOCUMENTS

| | | |
|---|---|---|
| DE | 20 2009 005562 | 6/2009 |
| EP | 2 859 960 | 4/2015 |
| GB | 1 376 695 | 12/1974 |
| SU | 584 898 | 12/1977 |
| WO | WO 2013/191535 | 12/2013 |
| WO | WO 2016/111624 | 7/2016 |

* cited by examiner

*Primary Examiner* — Christopher S Kim
*Assistant Examiner* — Juan C Barrera
(74) *Attorney, Agent, or Firm* — Nixon & Vanderhye P.C.

(57) ABSTRACT

An auxiliary element (1) for the local deposition of fluid for a fluid dispenser header (10), includes a hollow main body (2), including a hollow conduit (3) inside the main body (2), configured such that the fluid flows through its interior, comprising an opening for the inlet of fluid (5) coming from the fluid dispenser header at one end, and a fluid outlet opening (6) at the opposite end, a cavity (4) located between the wall of the main body (2) and the hollow conduit (3), configured such that residual particles of the fluid flow through its interior, at least one connecting mean (8) to the interior of the hollow conduit (3) to the residual particles cavity (4) and an opening (7) located on the main body (2), configured for the outlet of residual particles from the cavity (4).

15 Claims, 3 Drawing Sheets

AUXILIARY LOCAL FLUID DEPOSITION ELEMENT

RELATED APPLICATION

This application claims priority to and incorporates by reference European Patent Application 16173896.8 filed Jun. 10, 2016.

FIELD OF THE INVENTION

This invention refers to an auxiliary element for adapting fluid guns, such as paint spray guns, to provide the local deposition of fluid on parts, specifically to achieve the local deposition of paint on aircraft parts.

BACKGROUND OF THE INVENTION

During the manufacturing of aeronautical parts, it is necessary to carry out a series of stages to adapt zones susceptible to corrosion to aircraft operation conditions. For this purpose, extensive use is made of paints and other isolating protective substances, known for its low financial cost and ease of application. These substances protect zones such as riveted or bolted zones, so that their functioning does not deteriorate when they are exposed to operating conditions.

The usual way of carrying out this zone preparation is through the use of a brush, allowing the amount of substances to be applied in a controlled manner, and ensuring certain process quality. However, this system for the application of protective substances, such as paint or adhesives, requires excessive time due to the fact that it is done manually, and in many cases the worker is forced to perform the procedure in an uncomfortable position.

In cases where other methods are used for dispensing or spraying protective substances, most extensive use is made of so-called atomizers, normally paint guns.

These are a practical and quick solution, allowing materials, time and effort to be saved when protecting any surface type, thanks to the fact that they quickly expel pulverized material towards the surface to be protected or prepared. However, the material used tends to be toxic, and the fact that it is pulverized means that it remains in suspension in the atmosphere and that it is likely to be inhaled by the operator. To solve this health risk, masks are usually worn, and the process is carried out in ventilated areas.

In addition, this process is carried out at the manufacturing plant with large parts. As it is a minor task that does not affect the part to a great extent, it is not sufficiently relevant to transport parts to work areas that are ventilated or fitted out for working with atomizers; it becomes work done in situ.

However, if the zone to be painted is of a reduced section, and only a local deposition is necessary, guns do not meet the quality requirements, as the material spreads out over a zone of the part that is too large; in this case, preference is given to a slower but more effective procedure, namely the use of a brush.

SUMMARY OF THE INVENTION

This invention refers to an auxiliary element allowing the local deposition of the material while extracting the toxic products of the pulverization process.

The auxiliary element is an element that may be configured to adapt to most atomizers or pulverizers on the market. It is easy and quick to install and use.

The auxiliary element combines the advantages of conventional fluid products, such as paints: such as low cost and ease of application, with the advantages of pulverizers: speed and surface quality obtained. Furthermore, no fitted out or ventilated zones are required for the use of this auxiliary element, and masks are not needed, as excess pulverized material is not routed into the atmosphere and it passes directly to a volatiles sink.

The auxiliary element for the local deposition of fluid material, such as paint, for a fluid dispenser head, comprises a hollow main body comprising:

(i) a hollow conduit fitted inside the hollow main body, configured such that the fluid flows through its interior, comprising an opening for the inlet of fluid coming from the fluid dispenser at one end, and a fluid outlet opening at the opposite end, (ii) a cavity located between the wall of the main body and the internal hollow conduit, configured so that residual particles of the fluid can flow through its interior, (iii) at least one element connecting the interior of the hollow conduit to the residual particles cavity and (iv) an opening located on the main body, configured for the outlet of residual particles from the cavity.

The auxiliary element rests on the surface of the part, on the edge of the fluid outlet opening. This opening defines the maximum pulverization or fluid deposition area, and matches the size of the protuberance to be covered (such as rivets or bolt heads). Any pulverized material that does not adhere to the part remains in suspension and passes from the interior of the hollow conduit to the residual particles cavity, through connecting means located on the wall of the hollow conduit. These connecting means can be a passage or plurality of passages, such as holes or conduits. Excess pulverized material moves through the cavity to a volatiles sink, which is connected to the gas or volatile particles outlet opening.

SUMMARY OF DRAWINGS

To supplement the description that is being made, and with the aim of aiding a better understanding of the characteristics of the invention, according to a preferred example of its practical realization, attached as an integral part of this description are some drawings, representing the following with an illustrative and non-limiting nature.

DETAILED DESCRIPTION OF THE INVENTION

In an embodiment of the invention, the auxiliary element (1) for the local deposition of fluid, such as paint, comprises, as shown in FIGS. 1*a*, 1*b* and 2 to 4, includes a hollow main body (2), a hollow conduit (3) and a cavity (4).

Figure 1A:
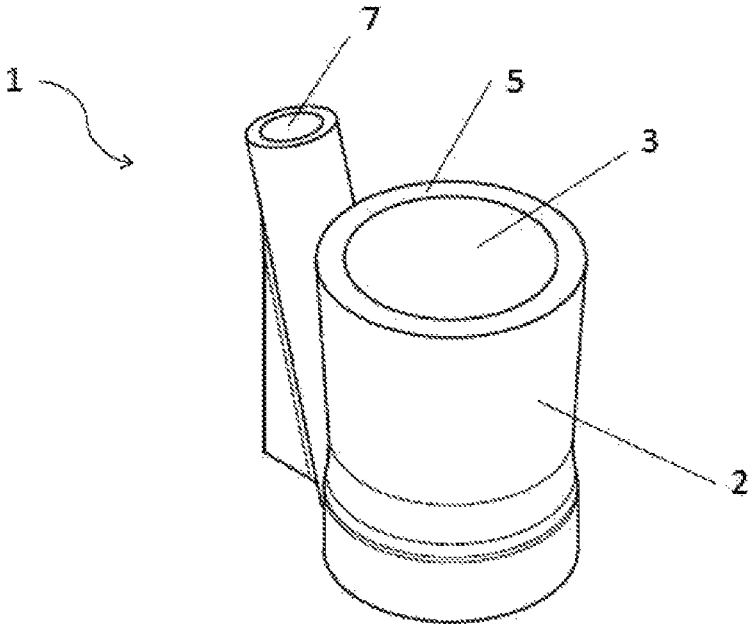
FIG. 1*a* shows a side perspective view of an auxiliary element for the local deposition of paint, according to an embodiment of the invention.
Figure 1B:
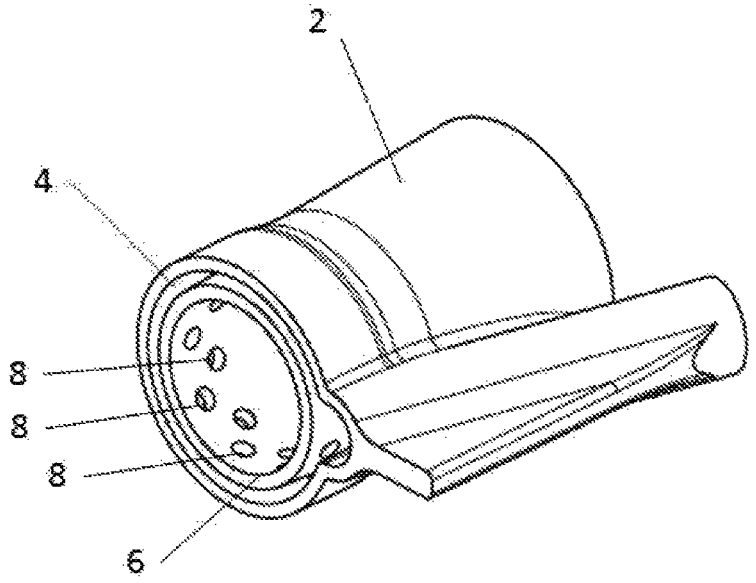
FIG. 1*b* shows a bottom perspective view of an auxiliary element for the local deposition of paint, according to a preferred realization.
Figure 2:
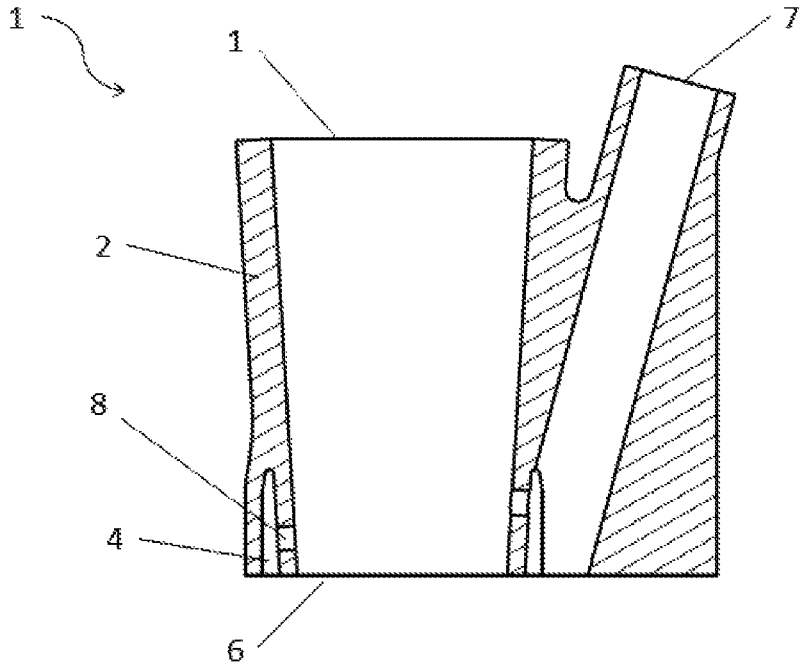
FIG. 2 shows a longitudinal cross section of the realization of FIG. 1.

The hollow main body (2) is the element forming the external wall of the auxiliary element (1), which may be bell shaped, as can be seen in FIGS. 1*a* and 1*b*.

The hollow conduit (3) is located inside the main body (2) and is used to channel the pulverized paint, which may also be protective or isolating material, through its interior. This material enters through one end of the hollow conduit (3) from a paint dispenser, through a paint inlet opening (5), and flows towards a paint outlet opening (6) at the opposite end.

The edge of the paint inlet opening (5) is in direct contact with the surface (18) of the part to be pulverized, and must have such dimensions as to allow the protuberance (9) to be pulverized to enter into the end of the hollow conduit (3), for the optimal deposition or dispersion of material over its surface. This optimal deposition must provide a minimal quantity of material to isolate the entire surface and grooves of the protuberance (9) from the exterior, and it must meet in-house quality standards, depending on the process.

The cavity (4) is located between the wall of the main body (2) and the hollow conduit (3), and through its interior pass the suspended particles of pulverized paint, or protective or isolating material if applicable, which are harmful to human health. These residual particles, such as volatiles or particles in suspension, are the excess pulverized material that does not adhere to the surface of the protuberance (9) or the surface (18) of the part. For these particles to pass from the interior of the hollow conduit (3) to the cavity (4) of residual particles, the hollow conduit (3) comprises a plurality of holes as a connecting means (8).

On the wall of the main body (2) there is an opening (7) that allows residual particles to exit the cavity (4), which will go to a volatiles sink.

Figure 3:
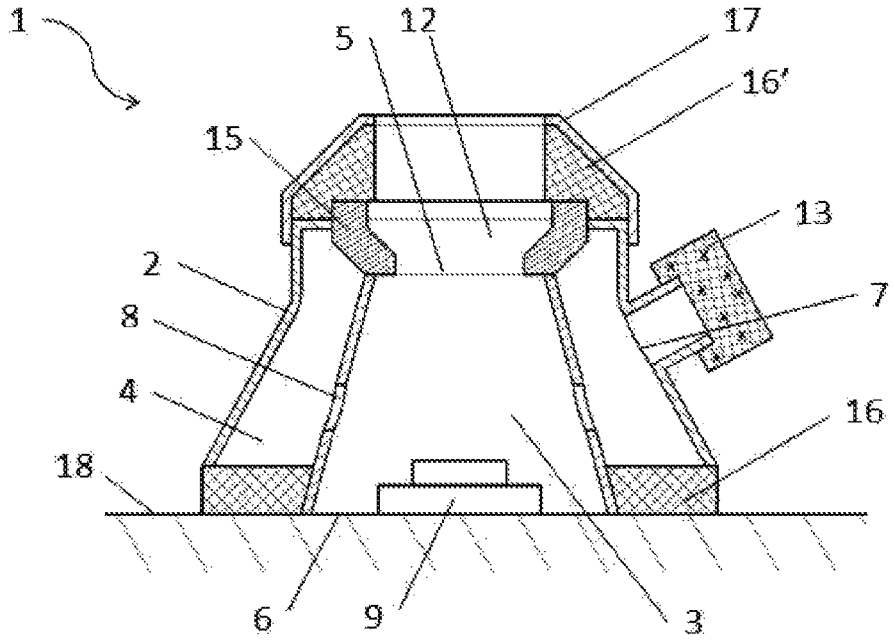
FIG. 3 shows a longitudinal cross section of a second realization.
Figure 4:
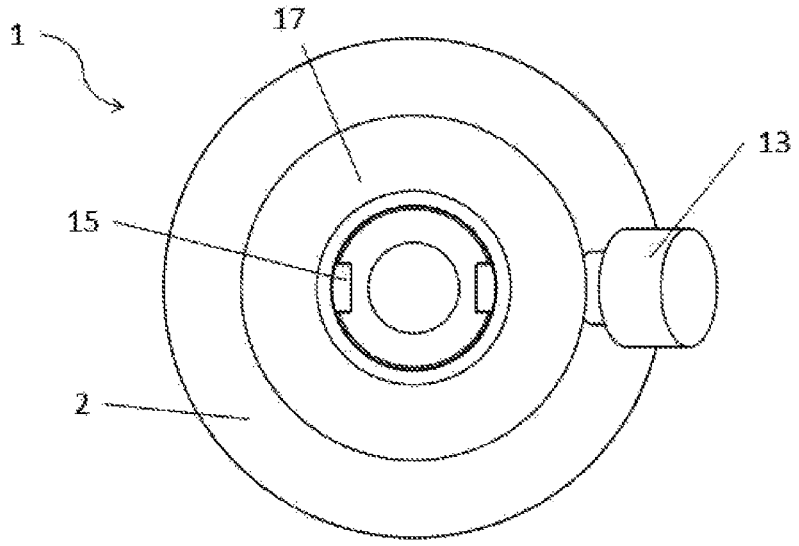
FIG. 4 shows a top view of the second realization of the invention.

According to a second embodiment, shown in FIGS. 3 and 4, to the residual particles outlet opening (7) is coupled, either directly or by means of an auxiliary conduit, not shown in the figures, a fixed volatiles sink, such as an air purification filter (13), or an extractable volatiles sink, such as an aspirator (14).

In this second embodiment, the inlet conduit (12) comprises a notch, or recess (15) with the shape of the header connection of the paint dispenser (11), or another pulverizer device, as applicable. This connection can either be universal or specific to a certain header (11).

In addition, the paint inlet opening (5) comprises an inlet conduit (12), configured to couple to the header of the paint dispenser (10), as can be seen in FIG. 3. The auxiliary element is fed with pulverized or non-pulverized material through this inlet conduit (12), and this inlet conduit (12) can have rigid or flexible shape depending on the operation to be carried out and the operating conditions. Furthermore, the paint inlet opening (5) and the paint outlet opening (6) comprise an absorbent retention material (16, 16') around their edges. In the paint outlet opening (5), the position of the auxiliary element (1) is improved on the surface (18) of the part, as the support section increases. This also prevents material leaking from the hollow conduit (3) through the paint inlet opening (5) to adjacent zones. Lastly, the absorbent retention material (16) allows the material deposition zone to be marked out so that it meets the quality requirements and does not extend further than necessary, achieving savings of materials.

Additionally, the absorbent retention material (16') around the edge of the paint inlet opening (5) also avoids the leakage of material through the part where material enters the auxiliary element (1) due to the fact that the pressure of the pulverized material is higher than atmospheric pressure.

This absorbent retention material (16, 16') may be a sponge or other low density material that makes the material inlet (5) and outlet (6) openings leak tight to prevent leakages and waste of material.

Lastly, the outermost layer of this second realization also comprises an elastomer material (17), which adapts to the shape of the header connection (11) of the paint dispenser, or any other element required to fasten the auxiliary element to the paint dispenser, and which also makes the material inlet opening (5) leak tight. This elastomer material (17) can be a rubber sheath.

Figure 5:
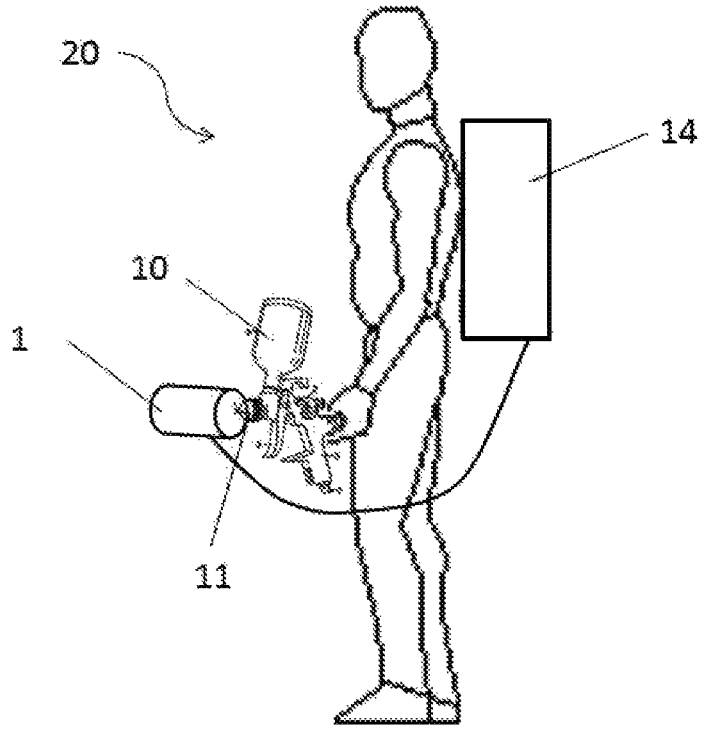
FIG. 5 shows a perspective view of the equipment for the local deposition of paint.

Another embodiment is shown in FIG. 5 and includes equipment (20) for the local deposition of paint, made up of:

(i) an auxiliary element (1) for the local deposition of paint, and (ii) a paint dispenser (10), such as a paint gun or other type of material pulverizer, which provides or feeds protective or isolating material to be deposited on the protuberance (9).

The embodiment shown in FIG. 5 may include an aspirator (14), which extracts excess pulverized material that does not adhere to the surface of the protuberance (9) or the surface (18) of the part, from the interior of the cavity (4) through the opening (7) of the residual particles outlet.

In addition, to automate the process, the auxiliary element (1), along with the paint dispenser and a volatiles sink, are connected to an automated articulated arm using grips, not shown in the figures. This system comprises control software to deposit material on the protuberances (9) from computational references.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An auxiliary element for the local deposition of fluid for a fluid dispenser header, wherein the auxiliary element includes a hollow main body which comprises:

a hollow conduit inside the main body and configured such that the fluid flows through an interior of the hollow conduit, wherein the hollow conduit comprises a fluid inlet opening to receive the fluid coming from the fluid dispenser header at one end of the hollow conduit, and a fluid outlet opening at an opposite end of the hollow conduit and the fluid outlet opening includes an edge extending entirely around a perimeter of the fluid outlet opening and the opposite end is configured to seat on a surface to receive the fluid or supporting a component to receive the fluid, a cavity located between an outer wall of the hollow main body and the hollow conduit, wherein the cavity is configured to receive residual particles of the fluid flow through the interior of the hollow conduit, at least one passage in the hollow conduit and establishing fluid flow of the residual particles from the interior of the hollow conduit to the cavity;

a residual particle opening located on the outer wall of the hollow main body, wherein the residual particle opening is configured to pass the residual particles from the cavity, and absorbent retention material covering each of an outer edge of the fluid inlet opening and an outer edge of the fluid outlet of the hollow conduit.

2. The auxiliary element for the local deposition of paint for a fluid dispenser header according to claim 1, wherein the fluid inlet opening comprises an inlet conduit, configured to couple to the header of the fluid dispenser.

3. The auxiliary element for the local deposition of fluid for a fluid dispenser header according to claim 2, wherein the inlet conduit comprises a notch or recess shaped to receive the header of the fluid dispenser.

4. The auxiliary element for the local deposition of paint for a fluid dispenser header, according to claim 1, wherein the at least one passage is a series of passages.

5. The auxiliary element for the local deposition of paint for a fluid dispenser header according to claim 1, wherein the at least one passage is a series of passages arranged in an array of the passages extending around the hollow conduit.

6. The auxiliary element for the local deposition of fluid for a fluid dispenser header according to claim 1, wherein an air purification filter is positioned in the residual particle opening.

7. The auxiliary element for the local deposition of fluid for a fluid dispenser header according to claim 1, wherein an outermost layer of the fluid inlet opening comprises an elastomer material.

8. An equipment assembly for the local deposition of a fluid comprising:

the auxiliary element of claim 1 and configured for the local deposition of the fluid, and a fluid dispenser configured to add fluid to the auxiliary element joined to the fluid inlet opening of the auxiliary element.

9. The equipment assembly for the local deposition of fluid, according to claim 8, wherein the equipment assembly comprises an aspirator coupled to the residual particles opening of the auxiliary element.

10. An auxiliary element configured for the local deposition of paint on a component on or adjacent a surface, the auxiliary element comprising:

a hollow main body having a first end configured to seat on the surface, a second end, opposite to the first end, configured to connect to a header of a paint spray device, and an interior chamber extending between the first and second ends of the main body;

an interior wall within the hollow main body and, at least partially, defining the interior chamber;

a cavity between the interior wall and an outer wall of the main body;

at least one passage in the interior wall which provides a passage for residual paint particles to flow from the interior chamber and into the cavity;

a residual particle outlet of the main body providing an opening from the cavity for the passage of the residual paint particles, and absorbent material covering each of the first and second ends of the hollow main body.

11. The auxiliary equipment of claim 10 wherein the annular element at the first end is sandwiched in an annular gap between an edge at the first end of the hollow main body and an edge at the first end of the interior wall.

12. The auxiliary equipment of claim 10 further comprising an annular elastomeric element configured to receive the header, and the annular elastomeric element is attached to the second end.

13. The auxiliary equipment of claim 10 wherein the interior wall has a frustoconical shape.

14. The auxiliary equipment of claim 10 wherein the at least one passage includes an array of passages distributed around a circumference of the hollow conduit.

15. An auxiliary element configured for the local deposition of paint on a component on or adjacent a surface, the auxiliary element comprising: a hollow main body having a first end configured to seat on the surface, a second end, opposite to the first end, configured to connect to a header of a paint spray device, and an interior chamber extending between the first and second ends of the main body; an interior wall within the hollow main body and, at least partially, defining the interior chamber and the interior wall including an edge extending around the interior chamber at the first end of the main body; a cavity between the interior wall and an outer wall of the main body; an annular absorbent material element filling an annular gap between an edge of the outer wall at the first end of the main body and the edge of the interior wall, wherein the edge of the outer wall and the gap extend entirely around the edge of the interior wall; wherein a second end of the hollow main body which is opposite to the first end also comprises an annular absorbent material element; at least one passage in the interior wall which provides a passage for residual paint particles to flow from the interior chamber and into the cavity; and a residual particle outlet of the main body providing an opening from the cavity for the passage of the residual paint particles.

* * * * *